US010655897B2

(12) United States Patent
Goel et al.

(10) Patent No.: US 10,655,897 B2
(45) Date of Patent: May 19, 2020

(54) METHOD AND APPARATUS FOR COMMON PRESSURE AND OIL EQUALIZATION IN MULTI-COMPRESSOR SYSTEMS

(71) Applicant: Lennox Industries Inc., Richardson, TX (US)

(72) Inventors: Rakesh Goel, Irving, TX (US); Siddarth Rajan, Dallas, TX (US)

(73) Assignee: Lennox Industries Inc., Richardson, TX (US)

( * ) Notice: Subject to any disclaimer, the term of this patent is extended or adjusted under 35 U.S.C. 154(b) by 8 days.

(21) Appl. No.: 15/824,060

(22) Filed: Nov. 28, 2017

(65) Prior Publication Data

US 2018/0274830 A1 Sep. 27, 2018

Related U.S. Application Data

(63) Continuation-in-part of application No. 15/606,571, filed on May 26, 2017, and a continuation-in-part of application No. 15/464,470, filed on Mar. 21, 2017.

(51) Int. Cl.
*F25B 1/10* (2006.01)
*F25B 31/00* (2006.01)
(Continued)

(52) U.S. Cl.
CPC ..... *F25B 31/00* (2013.01); *F25B 41/003* (2013.01); *F25B 41/04* (2013.01); *F25B 41/043* (2013.01);
(Continued)

(58) Field of Classification Search
CPC ..... F25B 49/02; F25B 41/043; F25B 2600/0251; F25B 2500/16;
(Continued)

(56) References Cited

U.S. PATENT DOCUMENTS 2,294,552 A 9/1942 Gygax
3,243,101 A 3/1966 Shaw
(Continued)

FOREIGN PATENT DOCUMENTS

EP 0403239 A2 12/1990
EP 1120611 A1 * 8/2001 ..... F25B 31/004

OTHER PUBLICATIONS

U.S. Appl. No. 15/464,470, Thobias et al.
(Continued)

*Primary Examiner* — Henry T Crenshaw
*Assistant Examiner* — Kamran Tavakoldavani
(74) *Attorney, Agent, or Firm* — Winstead PC

(57) ABSTRACT

The compressor system includes a first compressor, a second compressor, and a third compressor. A common equalization line fluidly couples the first compressor, the second compressor, and the third compressor. The common equalization line provides a single path for passage of fluids between the first compressor, the second compressor, and the third compressor. An obstruction device is disposed in the common equalization line between the first compressor and the second compressor. When the first compressor is deactivated, the second compressor is activated, and the third compressor is activated, the obstruction device is in a closed configuration. Prevention of fluid flow between the first compressor and the second compressor causes at least minimum prescribed fluid levels to be maintained in the first compressor, the second compressor, and the third compressor.

19 Claims, 12 Drawing Sheets

(51) Int. Cl.

| | |
|---|---|
| ***F25B 41/04*** | (2006.01) |
| ***F25B 41/06*** | (2006.01) |
| ***F25B 41/00*** | (2006.01) |
| ***F25B 49/02*** | (2006.01) |

(52) U.S. Cl.
CPC ..... *F25B 41/06* (2013.01); *F25B 49/02* (2013.01); *F25B 31/002* (2013.01); *F25B 2400/0751* (2013.01); *F25B 2500/16* (2013.01); *F25B 2500/27* (2013.01); *F25B 2600/0251* (2013.01); *F25B 2600/2519* (2013.01)

(58) Field of Classification Search
CPC ..... F25B 2400/0751; F25B 2600/2519; F25B 31/002; F25B 2500/27; F25B 2400/075; F25B 1/10; F25B 31/00; F25B 41/04
See application file for complete search history.

(56) References Cited

U.S. PATENT DOCUMENTS

| | | | | |
|---|---|---|---|---|
| 3,386,262 | A | 6/1968 | Hackbart et al. | |
| 3,785,169 | A * | 1/1974 | Gylland, Jr. | F04B 39/0207 62/468 |
| 4,141,676 | A | 2/1979 | Jannen et al. | |
| 4,269,261 | A | 5/1981 | Kountz et al. | |
| 4,383,802 | A | 5/1983 | Gianni et al. | |
| 4,418,548 | A | 12/1983 | Sawyer | |
| 4,729,228 | A | 3/1988 | Johnsen | |
| 4,741,674 | A * | 5/1988 | Tischer | F04B 49/02 417/295 |
| 4,750,337 | A | 6/1988 | Glamm | |
| 5,094,598 | A | 3/1992 | Amata et al. | |
| 6,186,758 | B1 | 2/2001 | Shaw | |
| 6,928,828 | B1 | 8/2005 | Taras et al. | |
| 6,948,916 | B2 | 9/2005 | Hebert | |
| 7,325,414 | B2 | 2/2008 | Taras et al. | |
| 7,469,555 | B2 | 12/2008 | Taras et al. | |
| 7,651,322 | B2 * | 1/2010 | Shaw | F04B 39/0207 417/228 |
| 8,215,122 | B2 | 7/2012 | Hyun et al. | |
| 8,641,395 | B2 | 2/2014 | Nemit, Jr. | |
| 9,551,351 | B2 | 1/2017 | De Bernardi et al. | |
| 9,599,118 | B2 | 3/2017 | Zhou et al. | |
| 2005/0091998 | A1 | 5/2005 | Cho et al. | |
| 2006/0225445 | A1 | 10/2006 | Lifson et al. | |
| 2018/0274835 | A1 | 9/2018 | Goel et al. | |

OTHER PUBLICATIONS

U.S. Appl. No. 15/464,606, Goel et al.
U.S. Appl. No. 15/671,243, Berg, et al.
U.S. Appl. No. 15/606,571, Goel, et al.

* cited by examiner

CALROOM TEST DATA RESULTS

CALROOM TEST DATA RESULTS

| FROM | TO | CEL VALVE POSITION | |
|---|---|---|---|
| IDLE | PL1 OR PL2 | CLOSE PRIOR TO CHANGE | 250 |
| IDLE | FL | KEEP OPEN | 252 |
| PL1 (PL2) | PL2 (PL1) | KEEP CLOSED | 254 |
| PL1 OR PL2 | FL | OPEN AFTER CHANGE | 256 |
| FL | PL1 OR PL2 | CLOSE PRIOR TO CHANGE | 258 |
| FL | IDLE | KEEP OPEN | 260 |

| | FROM | TO | LOGIC |
|---|---|---|---|
| 502 | IDLE | PL_100 | CLOSE VALVE BEFORE CHANGE |
| 504 | | PL_011 | CLOSE VALVE BEFORE CHANGE |
| 506 | | FL | VALVE REMAINS OPEN |
| 508 | PL_100 | IDLE | OPEN VALVE AFTER CHANGE |
| 510 | | PL_011 | VALVE REMAINS CLOSED |
| 512 | | FL | OPEN VALVE AFTER CHANGE |
| 514 | PL_011 | IDLE | OPEN VALVE AFTER CHANGE |
| 516 | | PL_100 | VALVE REMAINS CLOSED |
| 518 | | FL | OPEN VALVE AFTER CHANGE |
| 520 | FL | IDLE | VALVE REMAINS OPEN |
| 522 | | PL_100 | CLOSE VALVE BEFORE CHANGE |
| 524 | | PL_011 | CLOSE VALVE BEFORE CHANGE |

FIG. 5

| | LOAD | INLET (LBS/HR) | VALVE A | Comp_1 ENTRY | | Comp_2 ENTRY | | Comp_3 ENTRY | |
|---|---|---|---|---|---|---|---|---|---|
| | | | | FLOW RATE | % OF FLOW | FLOW RATE | % OF FLOW | FLOW RATE | % OF FLOW |
| 602 | FL | 2160 | OPEN | 764 | 35 | 658 | 31 | 738 | 34 |
| 604 | PL_011 | 1440 | CLOSE | 0 | 0 | 748 | 52 | 692 | 48 |
| 606 | PL_100 | 720 | CLOSE | 720 | 100 | 0 | 0 | 0 | 0 |

FIG. 6

| | LOAD | VALVE A | VALVE B |
|---|---|---|---|
| 802 | FL | OPEN | OPEN |
| 804 | PL_100 | CLOSE | CLOSE |
| 806 | PL_010 | CLOSE | CLOSE |
| 808 | PL_001 | CLOSE | CLOSE |
| 810 | PL_110 | OPEN | CLOSE |
| 812 | PL_101 | CLOSE | CLOSE |
| 814 | PL_011 | CLOSE | OPEN |

FIG. 8

METHOD AND APPARATUS FOR COMMON PRESSURE AND OIL EQUALIZATION IN MULTI-COMPRESSOR SYSTEMS

CROSS-REFERENCE TO RELATED APPLICATIONS

This patent application is a continuation-in-part of U.S. patent application Ser. No. 15/606,571, filed on May 26, 2017. This patent application is a continuation-in-part of U.S. patent application Ser. No. 15/464,470, filed on Mar. 21, 2017. U.S. patent application Ser. No. 15/606,571 and U.S. patent application Ser. No. 15/464,470 are each incorporated herein by reference.

TECHNICAL FIELD

The present invention relates primarily to heating, ventilation, and air conditioning ("HVAC") systems and more particularly, but not by way of limitation, to HVAC systems having multiple compressors with equalization lines between the compressors.

BACKGROUND

Compressor systems are commonly utilized in HVAC applications. Many HVAC applications utilize compressor systems that comprise two or more parallel-connected compressors. Such multi-compressor systems allow an HVAC system to operate over a larger capacity range than systems utilizing a single-speed compressor. Frequently, however, multi-compressor systems are impacted by disproportionate fluid distribution between the compressors. Such disproportionate fluid distribution results in inadequate lubrication, loss of performance, and reduction of useful life of the individual compressors in the multi-compressor system. Many present designs utilize mechanical devices, such as flow restrictors, to regulate fluid flow to each compressor. However, these mechanical devices are subject to wear and increased expense due to maintenance.

SUMMARY

The present invention relates primarily to heating, ventilation, and air conditioning ("HVAC") systems and more particularly, but not by way of limitation, to HVAC systems having multiple compressors with a common equalization line between the compressors. In one aspect, embodiments of the present invention relate to a compressor system. The compressor system includes a first compressor, a second compressor, and a third compressor. A common equalization line fluidly couples the first compressor, the second compressor, and the third compressor. The common equalization line provides a single path for passage of fluids between the first compressor, the second compressor, and the third compressor. An obstruction device is disposed in the common equalization line between the first compressor and the second compressor. When the first compressor is deactivated, the second compressor is activated, and the third compressor is activated, the obstruction device is in a closed configuration thereby preventing flow of fluid between active compressors of the first compressor and the second compressor and the third compressor and de-activated compressors of the first compressor and the second compressor and the third compressor. When the first compressor is activated, the second compressor is deactivated, and the third compressor is deactivated, the obstruction device is in a closed configuration thereby preventing flow of fluid between active compressors of the first compressor and the second compressor and the third compressor and de-activated compressors of the first compressor and the second compressor and the third compressor. Prevention of fluid flow between the first compressor and the second compressor causes at least minimum prescribed fluid levels to be maintained in the first compressor, the second compressor, and the third compressor.

In another aspect, embodiments of the present invention relate to a method of maintaining minimum prescribed fluid levels in a trio compressor system. The method includes utilizing the trio compressor system to operate in at least one of full-load operation in which all compressors of the trio compressor system are operational, partial-load operation in which at least one compressor of the trio compressor system is de-activated, and an idle state in which all compressors of the trio compressor system are deactivated. Responsive to the trio compressor system operating in partial-load operation, an obstruction device disposed between an active compressor and the at least one de-activated compressor of the trio compressor system is closed. The obstruction device prevents fluid flow from the at least one compressor that is de-activated into at least one compressor of the trio compressor system that is active. At least prescribed fluid levels are maintained in the compressors of the trio compressor system during partial-load operation.

In another aspect, embodiments of the present invention relate to a compressor system. The compressor system includes a first compressor, a second compressor, and a third compressor. A common equalization line fluidly couples the first compressor, the second compressor, and the third compressor. The common equalization line provides a single path for passage of fluids between the first compressor, the second compressor, and the third compressor. A first obstruction device is disposed in the common equalization line between the first compressor and the second compressor. A second obstruction device is disposed in the common equalization line between the second compressor and the third compressor. Responsive to one of the first compressor and the second compressor being deactivated while the other of the first compressor and the second compressor remains active, the first obstruction is closed prior to deactivation of the at least one of the first compressor and the second compressor thereby preventing flow of fluid between the first compressor and the second compressor. Responsive to one of the second compressor and the third compressor being deactivated while the other of the second compressor and the third compressor remains active, the second obstruction is closed prior to deactivation of the at least one of the second compressor and the third compressor thereby preventing flow of fluid between the second compressor and the third compressor.

BRIEF DESCRIPTION OF THE DRAWINGS

For a more complete understanding of the present invention and for further objects and advantages thereof, reference may now be had to the following description taken in conjunction with the accompanying drawings in which:

FIG. 5 is a table illustrating operating conditions of the exemplary trio compressor system of FIG. 4;

FIG. 6 is a table illustrating flow rates during full-load operation and partial-load operation of the exemplary compressor system of FIG. 4;

FIG. 8 is a table illustrating operating conditions of the exemplary trio compressor system of FIG. 7.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1A:
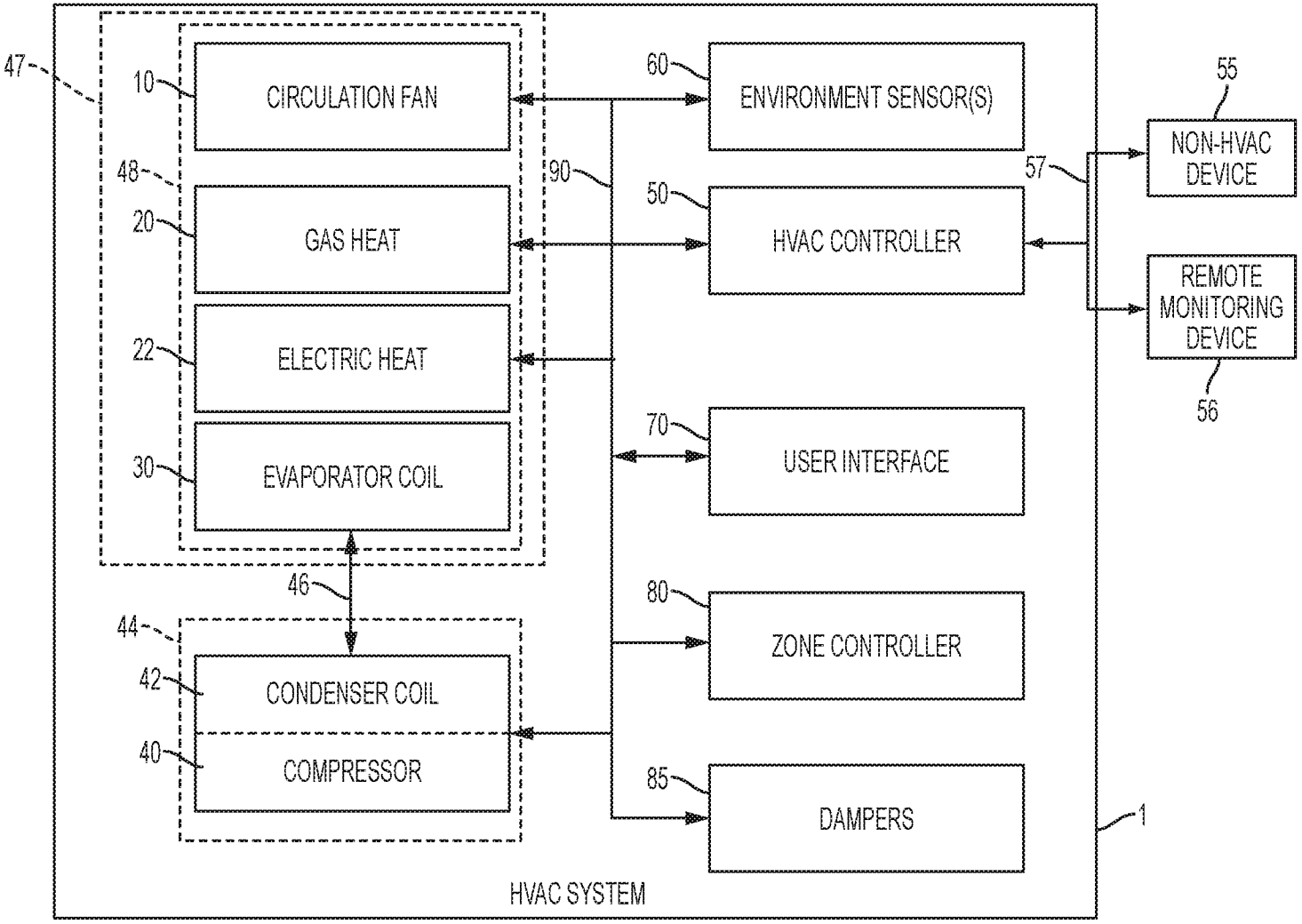
FIG. 1A is a block diagram of an HVAC system.

FIG. 1A illustrates an HVAC system 1. In a typical embodiment, the HVAC system 1 is a networked HVAC system that is configured to condition air via, for example, heating, cooling, humidifying, or dehumidifying air. The HVAC system 1 can be a residential system or a commercial system such as, for example, a roof top system. For exemplary illustration, the HVAC system 1 as illustrated in FIG. 1A includes various components; however, in other embodiments, the HVAC system 1 may include additional components that are not illustrated but typically included within HVAC systems.

The HVAC system 1 includes a circulation fan 10, a gas heat 20, an electric heat 22 typically associated with the circulation fan 10, and a refrigerant evaporator coil 30, also typically associated with the circulation fan 10. The circulation fan 10, the gas heat 20, the electric heat 22, and the refrigerant evaporator coil 30 are collectively referred to as an "indoor unit" 48. In a typical embodiment, the indoor unit 48 is located within, or in close proximity to, an enclosed space 47. The HVAC system 1 also includes a compressor 40 and an associated condenser coil 42, which are typically referred to as an "outdoor unit" 44. In various embodiments, the outdoor unit 44 is, for example, a rooftop unit or a ground-level unit. The compressor 40 and the associated condenser coil 42 are connected to an associated evaporator coil 30 by a refrigerant line 46. In a typical embodiment, the compressor 40 is, for example, a single-stage compressor, a multi-stage compressor, a single-speed compressor, or a variable-speed compressor. Also, as will be discussed in more detail below, in various embodiments, the compressor 40 may be a compressor system including at least two compressors of similar or different capacities. The circulation fan 10, sometimes referred to as a blower may, in some embodiments, be configured to operate at different capacities (i.e., variable motor speeds) to circulate air through the HVAC system 1, whereby the circulated air is conditioned and supplied to the enclosed space 47.

Still referring to FIG. 1A, the HVAC system 1 includes an HVAC controller 50 that is configured to control operation of the various components of the HVAC system 1 such as, for example, the circulation fan 10, the gas heat 20, the electric heat 22, and the compressor 40. In some embodiments, the HVAC system 1 can be a zoned system. In such embodiments, the HVAC system 1 includes a zone controller 80, dampers 85, and a plurality of environment sensors 60. In a typical embodiment, the HVAC controller 50 cooperates with the zone controller 80 and the dampers 85 to regulate the environment of the enclosed space 47.

The HVAC controller 50 may be an integrated controller or a distributed controller that directs operation of the HVAC system 1. In a typical embodiment, the HVAC controller 50 includes an interface to receive, for example, thermostat calls, temperature setpoints, blower control signals, environmental conditions, and operating mode status for various zones of the HVAC system 1. In a typical embodiment, the HVAC controller 50 also includes a processor and a memory to direct operation of the HVAC system 1 including, for example, a speed of the circulation fan 10.

Still referring to FIG. 1A, in some embodiments, the plurality of environment sensors 60 is associated with the HVAC controller 50 and also optionally associated with a user interface 70. In some embodiments, the user interface 70 provides additional functions such as, for example, operational, diagnostic, status message display, and a visual interface that allows at least one of an installer, a user, a support entity, and a service provider to perform actions with respect to the HVAC system 1. In some embodiments, the user interface 70 is, for example, a thermostat of the HVAC system 1. In other embodiments, the user interface 70 is associated with at least one sensor of the plurality of environment sensors 60 to determine the environmental condition information and communicate that information to the user. The user interface 70 may also include a display, buttons, a microphone, a speaker, or other components to communicate with the user. Additionally, the user interface 70 may include a processor and memory that is configured to receive user-determined parameters, and calculate operational parameters of the HVAC system 1 as disclosed herein.

In a typical embodiment, the HVAC system 1 is configured to communicate with a plurality of devices such as, for example, a monitoring device 56, a communication device 55, and the like. In a typical embodiment, the monitoring device 56 is not part of the HVAC system. For example, the monitoring device 56 is a server or computer of a third party such as, for example, a manufacturer, a support entity, a service provider, and the like. In other embodiments, the monitoring device 56 is located at an office of, for example, the manufacturer, the support entity, the service provider, and the like.

In a typical embodiment, the communication device 55 is a non-HVAC device having a primary function that is not associated with HVAC systems. For example, non-HVAC devices include mobile-computing devices that are configured to interact with the HVAC system 1 to monitor and modify at least some of the operating parameters of the HVAC system 1. Mobile computing devices may be, for example, a personal computer (e.g., desktop or laptop), a tablet computer, a mobile device (e.g., smart phone), and the like. In a typical embodiment, the communication device 55 includes at least one processor, memory and a user interface, such as a display. One skilled in the art will also understand that the communication device 55 disclosed herein includes other components that are typically included in such devices including, for example, a power supply, a communications interface, and the like.

The zone controller 80 is configured to manage movement of conditioned air to designated zones of the enclosed space 47. Each of the designated zones include at least one conditioning or demand unit such as, for example, the gas heat 20 and at least one user interface 70 such as, for example, the thermostat. The zone-controlled HVAC system 1 allows the user to independently control the temperature in the designated zones. In a typical embodiment, the zone controller 80 operates electronic dampers 85 to control air flow to the zones of the enclosed space 47.

In some embodiments, a data bus 90, which in the illustrated embodiment is a serial bus, couples various components of the HVAC system 1 together such that data is communicated therebetween. In a typical embodiment, the data bus 90 may include, for example, any combination of hardware, software embedded in a computer readable medium, or encoded logic incorporated in hardware or otherwise stored (e.g., firmware) to couple components of the HVAC system 1 to each other. As an example and not by way of limitation, the data bus 90 may include an Accelerated Graphics Port (ACP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 90 may include any number, type, or configuration of data buses 90, where appropriate. In particular embodiments, one or more data buses 90 (which may each include an address bus and a data bus) may couple the HVAC controller 50 to other components of the HVAC system 1. In other embodiments, connections between various components of the HVAC system 1 are wired. For example, conventional cable and contacts may be used to couple the HVAC controller 50 to the various components. In some embodiments, a wireless connection is employed to provide at least some of the connections between components of the HVAC system such as, for example, a connection between the HVAC controller 50 and the variable-speed circulation fan 10 or the plurality of environment sensors 60.

Figure 1B:
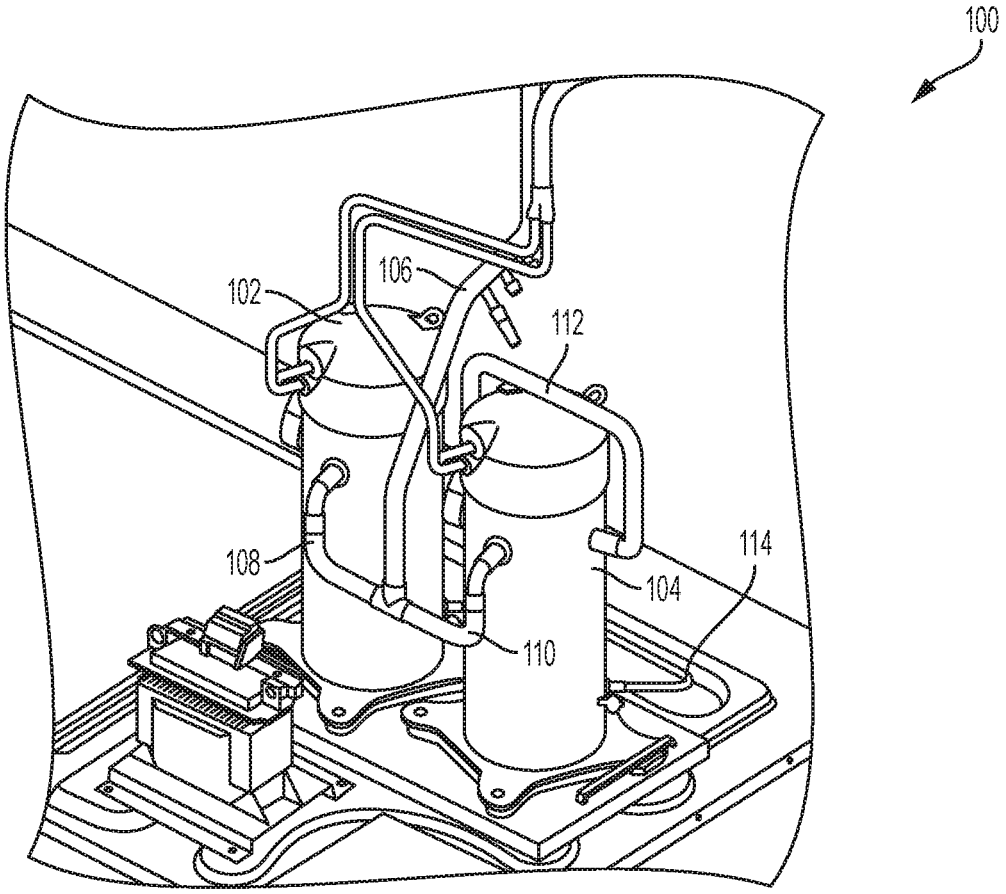
FIG. 1B is a schematic diagram of a compressor system.

FIG. 1B is a schematic diagram of a current tandem compressor system 100. The tandem compressor system 100 includes a first compressor 102 and a second compressor 104. A suction equalization line 112 is fluidly coupled to the first compressor 102 and the second compressor 104. A first branch suction line 108 is coupled to the first compressor 102 and a second branch suction line 110 is coupled to the second compressor 104. The first branch suction line 108 and the second branch suction line 110 are each fluidly coupled to a main suction line 106. An oil equalization line 114 couples the first compressor 102 and the second compressor 104 at a point above a minimum prescribed fluid level of the first compressor 102 and the second compressor 104. The oil equalization line 114 is typically coupled to the first compressor 102 and the second compressor 104 at a point between the minimum prescribed fluid level and the nominal fluid level. During full-load operation, both the first compressor 102 and the second compressor 104 are operating. In this scenario, the tandem compressor system 100 exhibits a suction pressure differential between the first compressor 102 and the second compressor 104 that results in the prescribed liquid level in the first compressor 102 and the second compressor 104 being maintained. In a typical embodiment, the prescribed liquid level is a factory-specified parameter for a particular compressor.

Figure 1C:
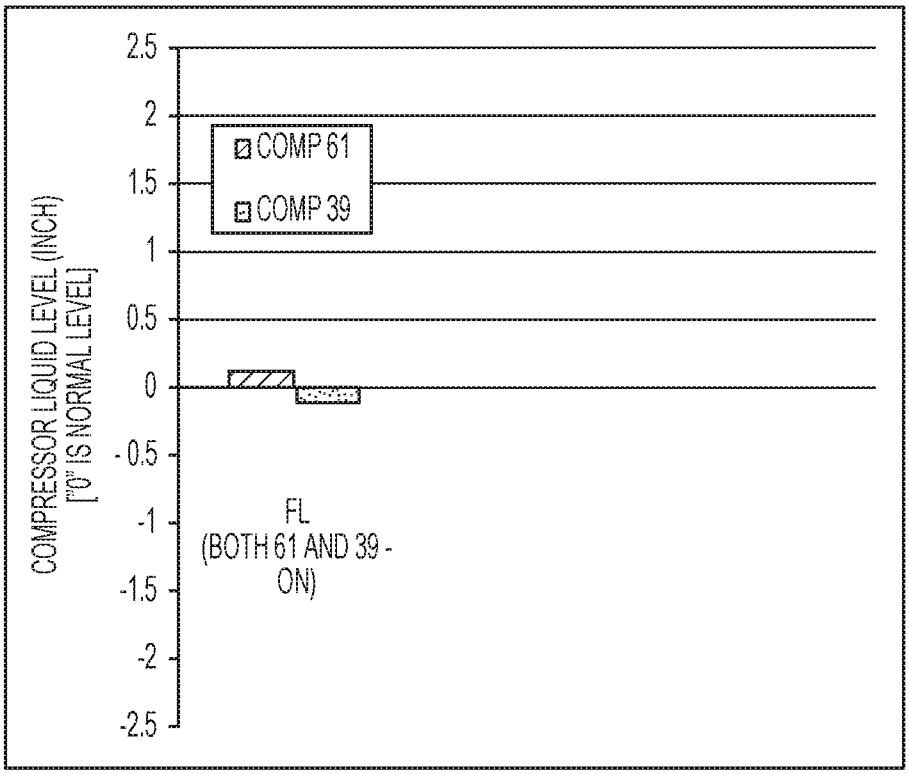
FIG. 1C is a table illustrating liquid levels in the compressor system of FIG. 1B during full-load operation.
Figure 1D:
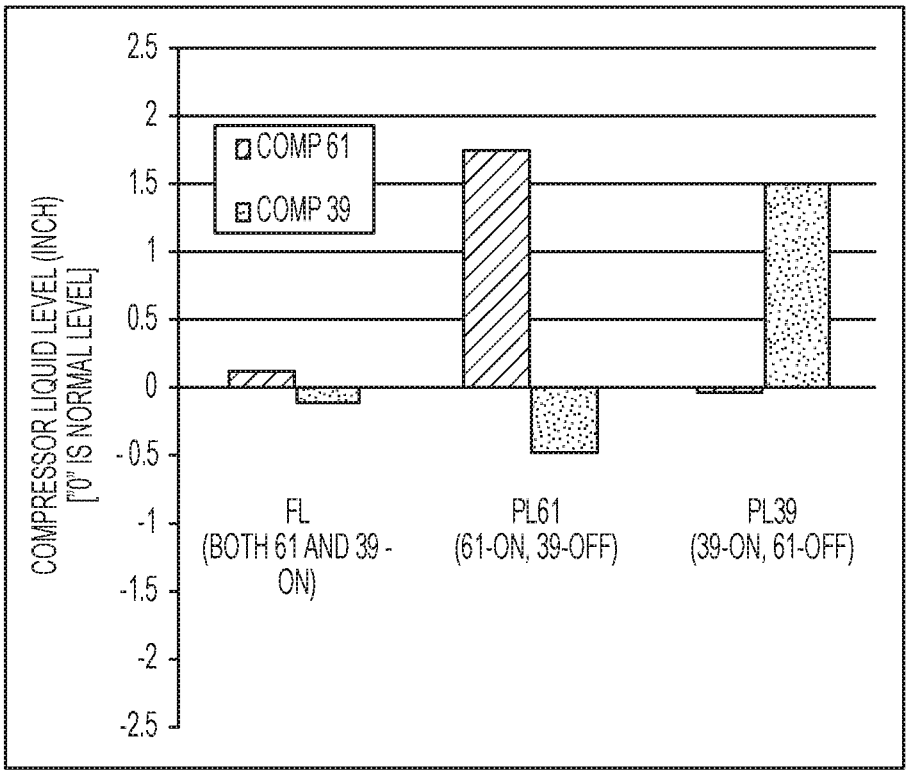
FIG. 1D is a table illustrating liquid levels in the compressor system of FIG. 1B during partial-load operation.

FIG. 1C is a table illustrating liquid levels in the compressor system 100 during full-load operation. FIG. 1D is a table illustrating liquid levels in the compressor system 100 during partial-load operation. For purposes of illustration, FIGS. 1C and 1D are discussed herein relative to FIG. 1B. By way of example, FIGS. 1C-1D illustrate a situation where the first compressor 102 and the second compressor 104 have unequal capacities; however, in other embodiment, the first compressor 102 and the second compressor 104 could have equal capacities. As shown in FIG. 1C, during full-load operation, the liquid level in the first compressor 102 and the second compressor 104 is close to a normal level, which is labeled as "0" in FIG. 1C. During partial-load operation, at least one of the first compressor 102 and the second compressor 104 is de-activated. De-activation of at least one of the first compressor 102 and the second compressor 104 disturbs the pressure balance between the first compressor 102 and the second compressor 104 that exists during full-load operation. As shown in FIG. 1D, during partial-load operation, the liquid level in at least one of the first compressor 102 and the second compressor 104 varies significantly from the normal liquid level. Such fluid imbalance between the first compressor 102 and the second compressor 104 can result in inadequate lubrication in one of the first compressor 102 and the second compressor 104. Inadequate lubrication results from a fraction of lubricant leaving a compressor with the refrigerant fluid and not returning to the compressor. Thus, fluid imbalance between compressors can also result in disproportionate lubricant distribution. Inadequate lubrication of compressors can adversely impact performance, efficiency, and lifespan of the first compressor 102 and the second compressor 104.

Figure 2A:
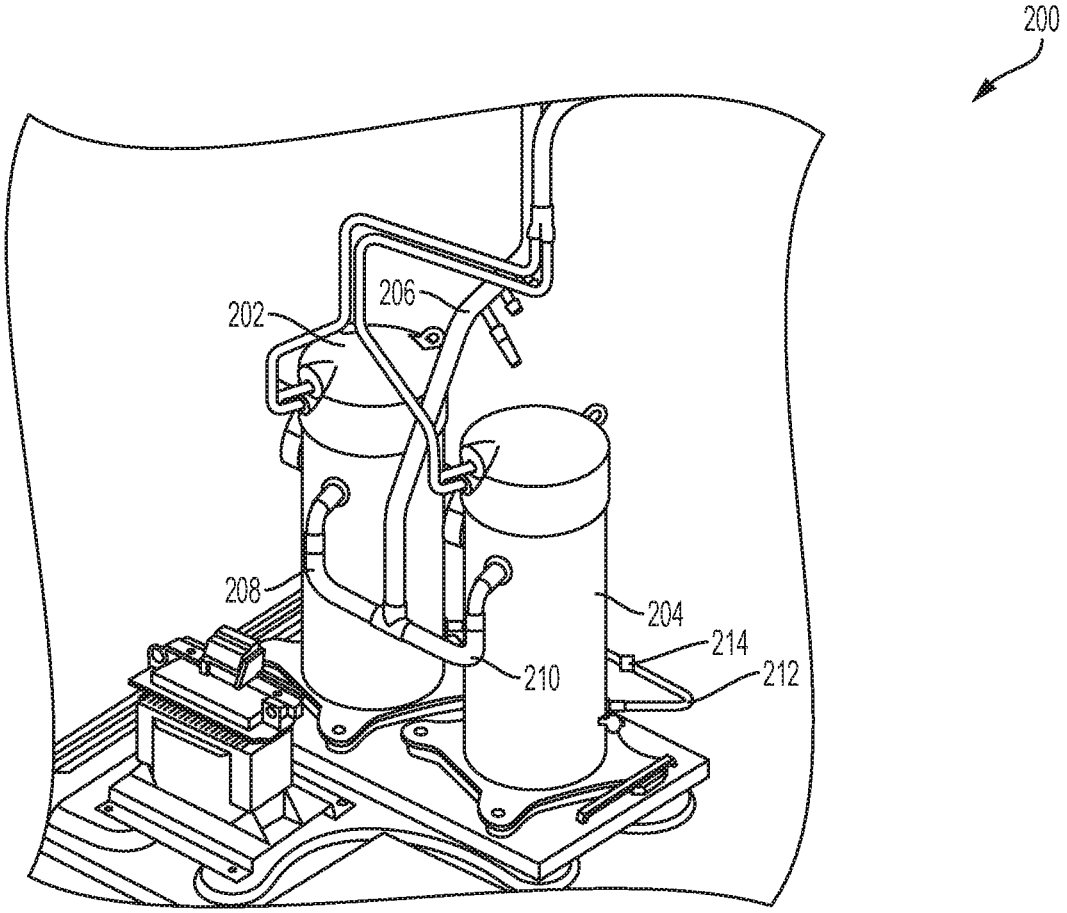
FIG. 2A is a schematic diagram of an exemplary multiple compressor system with a common equalization line.

FIG. 2A is a schematic diagram of an exemplary multiple-compressor system 200 with a common equalization line 212. By way of example, the multiple-compressor system 200 is illustrated in FIG. 2A as a tandem compressor system; however, in other embodiments, compressor systems utilizing principles of the invention could utilize any number of compressors as dictated by design requirements. The multiple-compressor system 200 includes a first compressor 202 and a second compressor 204. In a typical embodiment, the first compressor 202 and the second compressor 204 are of unequal capacities; however, in other embodiments, compressor systems utilizing principles of the invention may utilize compressors of approximately equal capacities. A main suction line 206 is disposed proximate the first compressor 202 and the second compressor 204. The main suction line 206 is then divided into a first branch suction line 208 and a second branch suction line 210. The first branch suction line 208 and the second branch suction line 210 are fluidly coupled to the first compressor 202 and the second compressor 204, respectively.

Still referring to FIG. 2A, a common equalization line 212 is fluidly coupled to the first compressor 202 and the second compressor 204. In a typical embodiment, the common equalization line 212 is coupled to the first compressor 202 and the second compressor 204 at a point above the minimum prescribed fluid level of the first compressor 202 and the second compressor 204. In a typical embodiment, the common equalization line 212 is coupled to the first compressor 202 and the second compressor 204 at a point between the minimum prescribed fluid level and the nominal fluid level. Thus a vertical position of the common equalization line 212, relative to a base of the first compressor 202 and the second compressor 204, is sufficient to allow passage of accumulated oil and gas between the first compressor 202 and the second compressor 204. Additionally, the common equalization line 212 facilitates equalization of pressure between the first compressor 202 and the second compressor 204. Thus, the common equalization line 212 provides a single path for passage of fluids between the first compressor 202 and the second compressor 204. In an exemplary embodiment, approximately one-fourth of a cross-sectional area of the common equalization line 212 is filled with oil and/or liquid refrigerant. In such an embodiment, the remaining three-fourths of the cross sectional area of the common equalization line 212 allows passage of gaseous refrigerant therethrough. In other embodiments, different liquid to gas ratios could be utilized. For example, in a typical embodiment, the common equalization line may have approximately 0 to approximately 50% of the cross-sectional area filled with oil and/or liquid refrigerant. In a particular embodiment, the common equalization line 212 has a diameter of, for example, ⅞ inch; however, in other embodiments the common equalization line 212 could have any diameter as dictated by design requirements.

Still referring to FIG. 2A, an obstruction device 214 is positioned in the common equalization line 212. In a typical embodiment, the obstruction device 214 is a valve such as, for example, a solenoid valve; however, in other embodiments, obstruction devices of any type could be utilized as dictated by design requirements. In a typical embodiment, the obstruction device 214 is capable of restricting flow of fluids such as, for example, oil, liquid refrigerant, and gaseous refrigerant, between the first compressor 202 and the second compressor 204 via the common equalization line 212. In a typical embodiment, the obstruction device 214 is biased in an open configuration. During full-load operation, the obstruction device 214 is the open configuration so as to permit flow of oil, liquid refrigerant, and gaseous refrigerant between the first compressor 202 and the second compressor 204 via the common equalization line 212. During partial-load operation such as, for example, when one of the first compressor 202 and the second compressor 204 is de-activated, the obstruction device 214 is closed to restrict flow of fluids such as, for example, oil, liquid refrigerant, and gaseous refrigerant, between the first compressor 202 and the second compressor 204 via the common equalization line 212. In this manner, the obstruction device 214 prevents fluid flow between the first compressor 202 and the second compressor 204 and causes the minimum prescribed fluid levels to be maintained in the first compressor 202 and the second compressor 204 during partial-load operation.

Figures 2B, 2C:
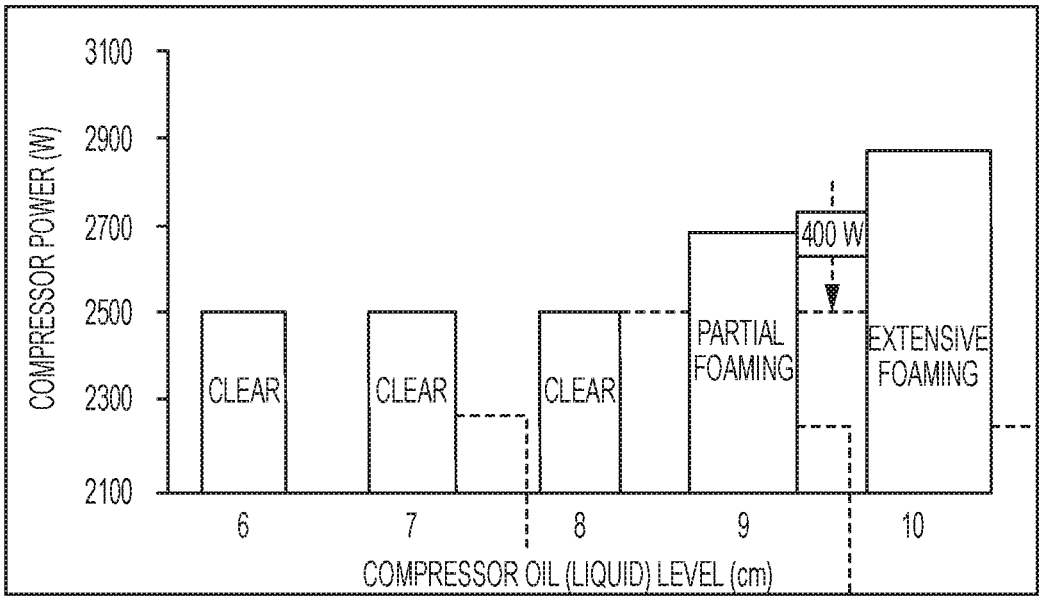
FIG. 2B is a table illustrating a plurality of transition modes of the exemplary multiple compressor system.
FIG. 2C is a table illustrating power consumption of the exemplary multiple-compressor system.

FIG. 2B is a table illustrating a plurality of transition triodes of the multiple-compressor system 200. For purposes of illustration, FIG. 2B is described herein relative to FIG. 2A. Transition 250, illustrates a scenario where the multiple-compressor system 200 is, at first, idle. That is, the first compressor 202 and the second compressor 204 are both de-activated. During the transition 250, the multiple-compressor system 200 transitions to partial-load operation. That is, one of the first compressor 202 and the second compressor 204 is operational. Prior to the transition 250, the obstruction device 214 is closed so as to restrict flow of fluids such as, for example, oil, liquid refrigerant, and gaseous refrigerant, between the first compressor 202 and the second compressor 204 via the common equalization line 212. Transition 252 illustrates a scenario where the multiple-compressor system 200 transitions from idle to full-load operation where both the first compressor 202 and the second compressor 204 are operational. Prior to the transition 252, the obstruction device 214 remains open to permit flow of fluids such as, for example, oil, liquid refrigerant, and gaseous refrigerant, between the first compressor 202 and the second compressor 204 via the common equalization line 212.

Still referring to FIG. 2B, transition 254 illustrates a scenario where the multiple-compressor system 200 transitions front partial-load operation with the first compressor 202 being operational to partial-load operation with the second compressor 204 being operational. During the transition 254, the obstruction device 214 remains closed so as to restrict flow of fluids such as, for example, oil, liquid refrigerant, and gaseous refrigerant, between the first compressor 202 and the second compressor 204 via the common equalization line 212. Transition 256 illustrates a scenario, where the multiple-compressor system 200 transitions from partial-load operation where one of the first compressor 202 and the second compressor 204 is operational to full-load operation where both of the first compressor 202 and the second compressor 204 are operational. After the transition 256, the obstruction device 214 is opened to permit flow of fluids such as, for example, oil, liquid refrigerant, and gaseous refrigerant, between the first compressor 202 and the second compressor 204 via the common equalization line 212. Transition 258 illustrates a scenario where the multiple-compressor system 200 transitions from full-load operation where both the first compressor 202 and the second compressor 204 are operational to partial-load operation where one of the first compressor 202 and the second compressor 204 is operational. Prior to the transition 258, the obstruction device 214 is closed so as to restrict flow of fluids such as, for example, oil, liquid refrigerant, and gaseous refrigerant, between the first compressor 202 and the second compressor 204 via the common equalization line 212. Transition 260 illustrates a scenario where the multiple-compressor system 200 transitions from full-load operation to idle. During the transition 260, the obstruction device 214 remains open so as to facilitate flow of fluids such as, for example, oil, liquid refrigerant, and gaseous refrigerant, between the first compressor 202 and the second compressor 204 via the common equalization line 212. In summary, FIG. 2B demonstrates that the obstruction device 214 is closed during partial-load operation and that the obstruction device is open during full-load operation and when the multiple-compressor system 200 is idle.

FIG. 2C is a table illustrating power consumption of the multiple-compressor system 200. For purposes of illustration, FIG. 2C is discussed herein relative to FIGS. 2A-2B. With reference to FIG. 1B, it has been found that, during partial-load operation, oil and refrigerant present in the deactivated compressor will be drawn through the oil equalization line 114 to the active compressor. Such a scenario causes an accumulation of fluid in the active compressor and starvation of fluid in the deactivated compressor. As illustrated in FIG. 2C, accumulation of fluid in the active compressor, causes increased power consumption by the active compressor. In the specific case of the multiple-compressor system 200, the obstruction device 214 is closed when the multiple-compressor system 200 is in partial-load operation. Closure of the obstruction device 214 prevents flow of fluid such as, for example, oil and refrigerant, from the deactivated compressor such as, for example, the second compressor 204 to the active compressor such as, for example, the first compressor 202. Thus, by closing the obstruction device 214 during partial-load operation, accumulation of fluid in the active compressor such as, for example, the first compressor 202 is prevented. By preventing accumulation of fluid in the first compressor 202, the partial-load power consumption of the multiple-compressor system 200 is reduced. Furthermore, use of the common equalization line 212 allows the first compressor 202 and the second compressor 204 to be constructed with one less port in the housing of the first compressor 202 and the second compressor 204. Such an arrangement reduces manufacturing costs and promotes ease of installation.

Figure 3:
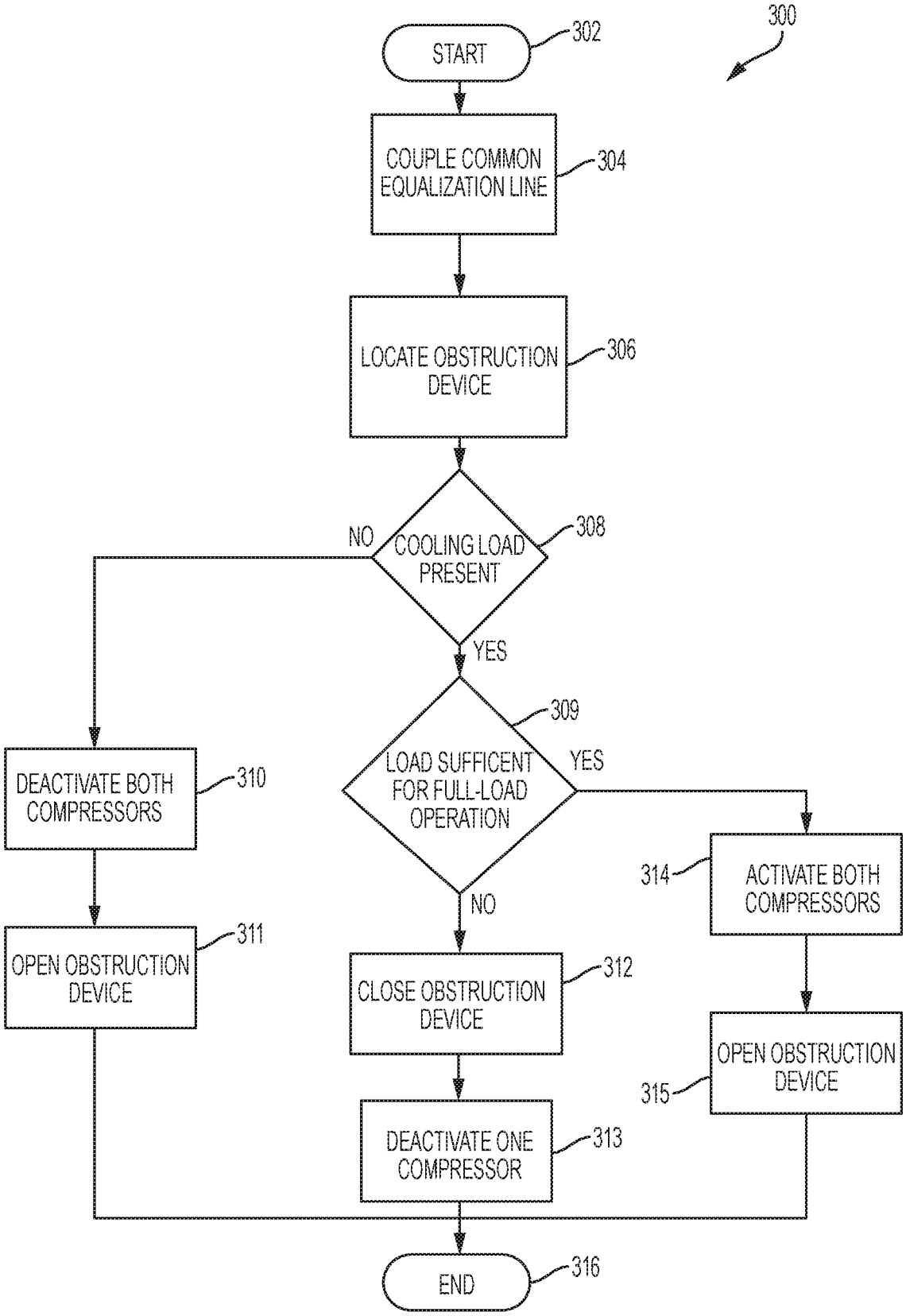
FIG. 3 is a flow diagram of an exemplary process for balancing fluid flow in the exemplary multiple-compressor system.

FIG. 3 is a flow diagram illustrating a process 300 for balancing compressor fluid levels during partial-load operation. For purposes of illustration, FIG. 3 is discussed herein relative to FIGS. 2A-2C. The process begins at step 302. At step 304, a common equalization line 212 is fluidly coupled to the first compressor 202 and the second compressor 204. At step 306, an obstruction device 214 is disposed in the common equalization line 212 such that, when closed, the obstruction device 214 prevents flow of fluids such as, for example, oil, liquid refrigerant, and gaseous refrigerant, between the first compressor 202 and the second compressor 204 via the common equalization line 212. At step 308, it is determined if a cooling load is present in the enclosed space. If, at step 308, it is determined that no cooling load is present in the enclosed space, the process 300 proceeds to step 310. At step 310, both the first compressor 202 and the second compressor 204 are deactivated and the multiple-compressor system 200 idles. At step 311, the obstruction device 214 is opened after deactivation of the first compressor 202 and the second compressor 204 so as to allow flow of fluids such as, for example, oil, liquid refrigerant, and gaseous refrigerant, between the first compressor 202 and the second compressor 204 via the common equalization line 212. If, at step 308, it is determined that a cooling load is present, the process 300 proceeds to step 309. At step 309, it is determined if the cooling load is sufficient for full-load operation of the multiple-compressor system 200. If at step 309, it is determined that the cooling load is not sufficient for full-load operation, the multiple-compressor system 200 operates in partial-load operation and the process 300 proceeds to step 312. At step 312, the obstruction device 214 is closed to prevent flow of fluids such as, for example, oil, liquid refrigerant, and gaseous refrigerant, between the first compressor 202 and the second compressor 204 via the common equalization line 212. At step 313, one of the first compressor 202 and the second compressor 204 is deactivated after closing the obstruction device 214. If, at step 309, it is determined that the cooling load present is sufficient for full-load operation, the process 300 proceeds to step 314. At step 314, both the first compressor 202 and the second compressor 204 are activated. At step 315, the obstruction device 214 is opened after activation of the first compressor 202 and the second compressor 204 so as to allow flow of fluids such as, for example, oil, liquid refrigerant, and gaseous refrigerant, between the first compressor 202 and the second compressor 204 via the common equalization line 212. The process 300 ends at step 316.

Figure 4:
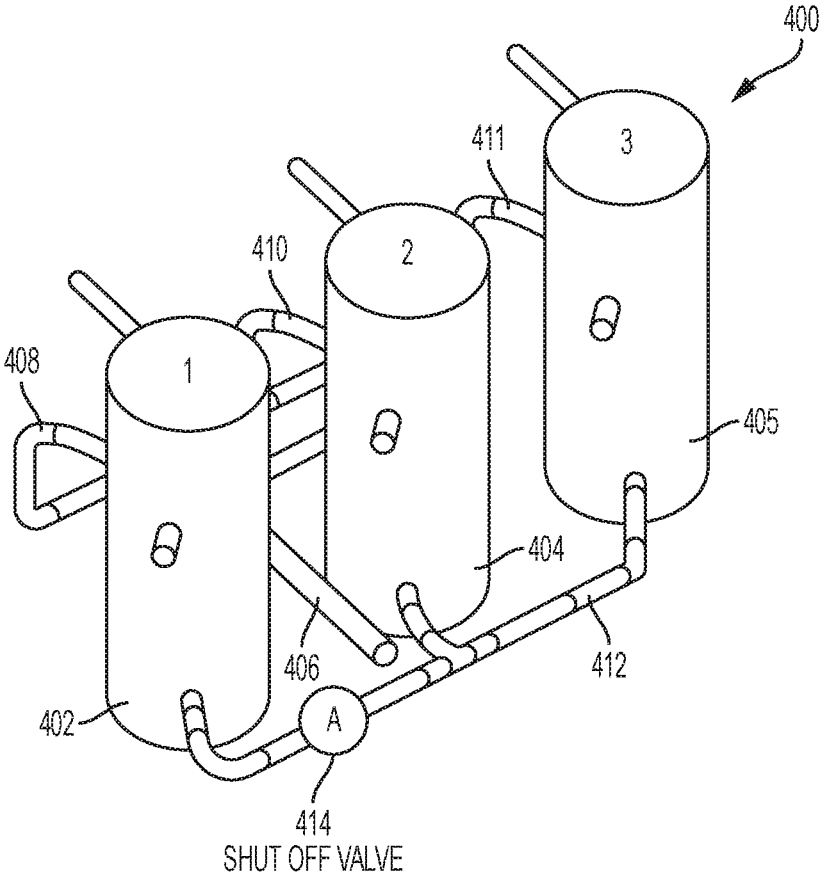
FIG. 4 is a schematic diagram of an exemplary trio compressor system with a common equalization line.

FIG. 4 is a schematic diagram of an exemplary trio compressor system 400 with a common equalization line 412. The trio compressor system 400 includes a first compressor 402, a second compressor 404, and a third compressor 405. In a typical embodiment the first compressor 402, the second compressor 204, and the third compressor 405 are of approximately equal capacities; however, in other embodiments, compressor systems utilizing principles of the invention may utilize compressors of unequal capacities. A main suction line 406 is disposed proximate the first compressor 402, the second compressor 404, and the third compressor 405. The main suction line 406 is then divided into a first branch suction line 408, a second branch suction line 410, and a third branch suction line 411. The first branch suction line 408, the second branch suction line 410, and the third branch suction line 411 are fluidly coupled to the first compressor 402, the second compressor 404, and the third compressor 405, respectively.

Still referring to FIG. 4, the common equalization line 412 is fluidly coupled to the first compressor 402, the second compressor 404, end the third compressor 405. In a typical embodiment, the common equalization line 412 is coupled to the first compressor 402, the second compressor 404, and the third compressor 405 at a point between the minimum prescribed fluid level and the nominal fluid level. The junction of the common equalization line should not be located below the minimum prescribed fluid level of the first compressor 402, the second compressor 404, and the third compressor 405. Thus a vertical position of the common equalization line 412 is sufficient to allow passage of accumulated oil and gas between the first compressor 402, the second compressor 404, and the third compressor 405. Additionally, the common equalization line 412 facilitates equalization of pressure between the first compressor 402, the second compressor 404, and the third compressor 405. Thus, the common equalization line 412 provides a single path for passage of fluids between the first compressor 402, the second compressor 404, and the third compressor 405. In an exemplary embodiment, approximately one-fourth of a cross-sectional area of the common equalization line 412 is filled with at least one of oil and liquid refrigerant. In such an embodiment, the remaining three-fourths of the cross sectional area of the common equalization line 412 allows passage of gaseous refrigerant therethrough. In other embodiments, different liquid to gas ratios could be utilized. For example, in a typical embodiment, the common equalization line 412 may have approximately 0 to approximately 50% of the cross-sectional area filled with at least one of oil and liquid refrigerant. In a particular embodiment, the common equalization line 412 has a diameter of, for example, ⅞ inch; however, in other embodiments the common equalization line 412 could have any diameter as dictated by design requirements.

Still referring to FIG. 4, an obstruction device 414 is positioned in the common equalization line 412. In a typical embodiment, the obstruction device 414 is a valve such as, for example, a solenoid valve; however, in other embodiments, obstruction devices of any type could be utilized as dictated by design requirements. In a typical embodiment, the obstruction device 414 is capable of restricting flow of fluids such as, for example, oil, liquid refrigerant, and gaseous refrigerant, between the first compressor 402, the second compressor 404, and the third compressor 405 via the common equalization line 412. In a typical embodiment, the obstruction device 414 is biased in an open configuration. During full-load operation, the obstruction device 414 is in the open configuration so as to permit flow of oil, liquid refrigerant, and gaseous refrigerant between the first compressor 402, the second compressor 404, and the third compressor 405 via the common equalization line 412. During partial-load operation such as, for example, when one of the first compressor 402, the second compressor 404, and the third compressor 405 is de-activated, the obstruction device 414 is in a closed configuration to restrict flow of fluids such as, for example, oil, liquid refrigerant, and gaseous refrigerant, between the first compressor 402, the second compressor 404, and the third compressor 405 via the common equalization line 412. In this manner, the obstruction device 414 prevents fluid flow between the first compressor 402, the second compressor 404, and the third compressor 405 and causes the minimum prescribed fluid levels to be maintained in the first compressor 402, the second compressor 404, and the third compressor 405 during partial-load operation. Placing the obstruction device 414 in the closed configuration also prevents fluid starvation in deactivated compressors.

FIG. 5 is a table illustrating a plurality of transition modes of the trio compressor system 400. For purposes of illustration, FIG. 5 is described herein relative to FIG. 4. In FIGS. 5-6 and 8, the notation "FL" denotes operation of the compressor system 700 in full-load operation, "PL_100" denotes operation of the compressor system 700 in partial-load operation with only the first compressor 402 activated, "PL_010" denotes operation of the compressor system 700 with only the second compressor 404 activated, and "PL_001" denotes operation of the compressor system 700 with only the third compressor 405 activated. Similarly, the notation "PL_110" denotes operation of the compressor system 700 in partial-load operation with the first compressor 402 and the second compressor 404 activated, "PL_101" denotes operation of the compressor system 700 with the first compressor 402 and the third compressor 405 activated, and "PL_011" denotes operation of the compressor system 700 with the second compressor 404 and the third compressor 405 activated. Transition 502, illustrates a scenario where the trio compressor system 400 is, at first, idle. That is, the first compressor 402, the second compressor 404, and the third compressor 405 are de-activated. During the transition 502, the trio compressor system 400 transitions to partial-load operation where the first compressor 402 is activated. Prior to the transition 502, the obstruction device 414 is moved to the closed configuration so as to restrict flow of fluids such as, for example, oil, liquid refrigerant, and gaseous refrigerant, between active compressors of the first compressor 402, the second compressor 404, and the third compressor 405 and de-activated compressors of the first compressor 402, the second compressor 404, and the third compressor 405 via the common equalization line 412. Transition 504 illustrates a scenario where the trio compressor system 400 transitions from idle to partial-load operation with the second compressor 404 and the third compressor 405 activated. Prior to the transition 504, the obstruction device 414 is moved to the closed configuration so as to restrict flow of fluids such as, for example, oil, liquid refrigerant, and gaseous refrigerant between active compressors of the first compressor 402, the second compressor 404, and the third compressor 405 and deactivated compressors of the first compressor 402, the second compressor 404, and the third compressor 405. Transition 506 illustrates a scenario where the trio compressor system 400 transitions from idle to full load operation. During full-load operation, the first compressor 402, the second compressor 404, and the third compressor 405 are activated. During transition 506, the obstruction device 414 remains in the open configuration to permit flow of fluids such as, for example, oil, liquid refrigerant, and gaseous refrigerant between the first compressor 402, the second compressor 404, and the third compressor 405.

Transition 508 illustrates a scenario where the trio compressor system 400 is first in partial-load operation with the first compressor 402 activated. During transition 508, the trio compressor system 400 transitions from partial-load operation to idle. After the transition 508, the obstruction device 414 moves to the open configuration to permit flow of fluids such as, for example, oil, liquid refrigerant, and gaseous refrigerant, between the first compressor 402, the second compressor 404, and the third compressor 405 via the common equalization line 412. Transition 510 illustrates a scenario where the trio compressor system 400 transitions from partial-load operation with the first compressor 402 active to partial load operation with the second compressor 404 and the third compressor 405 active. During the transition 510, the obstruction device 414 remains in the closed configuration so as to restrict flow of fluids such as, for example, oil, liquid refrigerant, and gaseous refrigerant between active compressors of the first compressor 402, the second compressor 404, and the third compressor 405 and de-activated compressors of the first compressor 402, the second compressor 404, and the third compressor 405. Transition 512 illustrates a scenario where the trio compressor system 400 transitions from partial load operation to full load operation where the first compressor 402, the second compressor 404, and the third compressor 405 are operational. After the transition 512, the obstruction device 414 moves to the open configuration to permit flow of fluids such as, for example, oil, liquid refrigerant, and gaseous refrigerant, between active compressors of the first compressor 402, the second compressor 404, and the third compressor 405 and de-activated compressors of the first compressor 402, the second compressor 404, and the third compressor 405 via the common equalization line 412.

Transition 514 illustrates a scenario where the trio compressor system 400 is first in partial-load operation with the second compressor 404 and the third compressor 405 activated. During transition 514, the trio compressor system 400 transitions from partial-load operation to idle. After the transition 514, the obstruction device 414 moves to the open configuration to permit flow of fluids such as, for example, oil, liquid refrigerant, and gaseous refrigerant, between the first compressor 402, the second compressor 404, and the third compressor 405 via the common equalization line 412. Transition 516 illustrates a scenario where the trio compressor system 400 transitions from partial-load with the second compressor 404 and the third compressor 405 active to partial load operation with the first compressor 402 active. During the transition 516, the obstruction device 414 remains in the closed configuration so as to restrict flow of fluids such as, for example, oil, liquid refrigerant, and gaseous refrigerant between active compressors of the first compressor 402, the second compressor 404, and the third compressor 405 and de-activated compressors of the first compressor 402, the second compressor 404, and the third compressor 405. Transition 518 illustrates a scenario where the trio compressor system 400 transitions from partial load operation to full load operation where the first compressor 402, the second compressor 404, and the third compressor 405 are operational. After the transition 518, the obstruction device 414 moves to the open configuration to permit flow of fluids such as, for example, oil, liquid refrigerant, and gaseous refrigerant, between the first compressor 402, the second compressor 404, and the third compressor 405 via the common equalization line 412.

Transition 520 illustrates a scenario where the trio compressor system 400 is first in full-load operation with the first compressor 402, the second compressor 404, and the third compressor 405 activated. During transition 520, the trio compressor system transitions from full-load operation to idle. During transition 520, the obstruction device 414 remains in the open configuration to permit flow of fluids such as, for example, oil, liquid refrigerant, and gaseous refrigerant, between the first compressor 402, the second compressor 404, and the third compressor 405 via the common equalization line 412. Transition 522 illustrates a scenario where the trio compressor system 400 transitions from full-load operation to partial-load operation with the first compressor 402 activated. Prior to transition 522, the obstruction device 414 closes to so as to restrict flow of fluids such as, for example, oil, liquid refrigerant, and gaseous refrigerant between active compressors of the first compressor 402, the second compressor 404, and the third compressor 405 and de-activated compressors of the first compressor 402, the second compressor 404, and the third compressor 405. Transition 524 illustrates a scenario where the trio compressor system transitions from full-load operation to partial-load operation with the second compressor 404 and the third compressor 405 activated. Prior to transition 524, the obstruction device 414 closes to so as to restrict flow of fluids such as, for example, oil, liquid refrigerant, and gaseous refrigerant between active compressors of the first compressor 402, the second compressor 404, and the third compressor 405 and de-activated compressors of the first compressor 402, the second compressor 404, and the third compressor 405.

FIG. 6 is a table illustrating flow rates during full-load operation and partial-load operation of the trio compressor system 400. For purposes of illustration, FIG. 6 is described herein relative to FIG. 4. Scenario 602 illustrates the trio compressor system 400 at full-load operation with the first compressor 402, the second compressor 404, and the third compressor 405 operational. During scenario 602, the obstruction device 414 is in the open configuration allowing flow of fluids such as, for example, oil, liquid refrigerant, and gaseous refrigerant between the first compressor 402, the second compressor 404, and the third compressor 405. As illustrated by scenario 602, the fluid flow into the first compressor 402, the second compressor 404, and the third compressor 405 is approximately equal. Scenario 604 illustrates the trio compressor system 400 at partial-load operation with the second compressor 404 and the third compressor 405 operational. During scenario 604, the obstruction device 414 is in the closed configuration thereby restricting flow of fluids such as, for example, oil, liquid refrigerant, and gaseous refrigerant between active compressors of the first compressor 402, the second compressor 404, and the third compressor 405 and de-activated compressors of the first compressor 402, the second compressor 404, and the third compressor 405. As illustrated by scenario 604, the fluid flow into the second compressor 404 and the third compressor 405 is approximately equal. Scenario 606 illustrates the trio compressor system 400 in partial-load operation with the first compressor 402 operational. During scenario 606, the obstruction device 414 is in the closed configuration. As illustrated by scenario 606 all of the fluid flow is into the first compressor 402.

Figure 7:
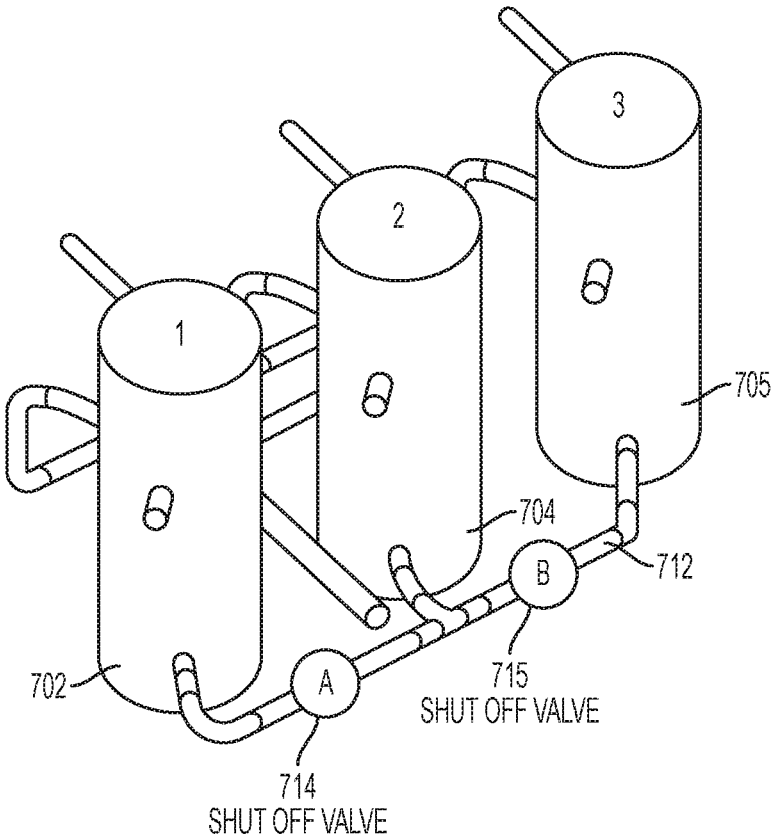
FIG. 7 is a schematic diagram of an exemplary trio compressor system having two obstruction devices.

FIG. 7 is a schematic diagram of an exemplary trio compressor system 700 having a first obstruction device 714 and a second obstruction device 715. The trio compressor system 700 is similar in construction and operation to the trio compressor system 400. A first compressor 702, a second compressor 704, and a third compressor 705 may be of any capacity. The first obstruction device 714 is positioned in the common equalization line 712, between the first compressor 702 and the second compressor 704. The second obstruction device 715 is positioned in the common equalization line 712 between the second compressor 704 and the third compressor 705. In a typical embodiment, the first obstruction device 714 and the second obstruction device 715 are valves such as, for example, solenoid valves; however, in other embodiments, obstruction devices of any type could be utilized as dictated by design requirements. In a typical embodiment, the first obstruction device 714 and the second obstruction device 715 are capable of restricting flow of fluids such as, for example, oil, liquid refrigerant, and gaseous refrigerant, between the first compressor 702, the second compressor 704, and the third compressor 705 via the common equalization line 712. In a typical embodiment, the first obstruction device 714 and the second obstruction device 715 are biased in an open configuration. The first obstruction device 714 and the second obstruction device 715 facilitate run time management of the first compressor 702, the second compressor 704, and the third compressor 705.

FIG. 8 is a table illustrating operating conditions of the exemplary trio compressor system 700. For purposes of illustration, FIG. 8 is described herein relative to FIG. 7. As illustrated by scenario 802, during full-load operation, the first obstruction device 714 and the second obstruction device 715 are in the open configuration so as to permit flow of oil, liquid refrigerant, and gaseous refrigerant between the first compressor 702, the second compressor 704, and the third compressor 705 via the common equalization line 712. As illustrated by scenario 804, scenario 806, and scenario 808, during partial-load operation where a single compressor is operational such as, for example, when one of the first compressor 702, the second compressor 704, and the third compressor 705 is activated, the first obstruction device 714 and the second obstruction device 715 are in the closed configuration to restrict flow of fluids such as, for example, oil, liquid refrigerant, and gaseous refrigerant, between the first compressor 702, the second compressor 704, and the third compressor 705 via the common equalization line 712. In this manner, the first obstruction device 714 and the second obstruction device 715 prevent fluid flow between the first compressor 702, the second compressor 704, and the third compressor 705 and causes the minimum prescribed fluid levels to be maintained in the first compressor 702, the second compressor 704, and the third compressor 705 during partial-load operation.

Still referring to FIG. 8, scenario 810 illustrates the trio compressor system 700 during partial-load operation with the first compressor 702 and the second compressor 704 activated and the third compressor 705 deactivated. During scenario 810, the first obstruction device 714 is in the open configuration to allow passage of fluids between the first compressor 702 and the second compressor 704 and the second obstruction device 715 is in the closed configuration to restrict passage of fluids to the third compressor 705. Scenario 812 illustrates the trio compressor system 700 in partial-load operation with the first compressor 702 and the third compressor 705 activated and the second compressor 704 deactivated. During scenario 812, the first obstruction device 714 and the second obstruction device 715 are in the closed configuration so as to restrict flow of fluids between the first compressor 702, the third compressor 705, and the second compressor 704. Scenario 814 illustrates the trio compressor system 700 in partial-load operation with the second compressor 704 and the third compressor 705 activated and the first compressor 702 deactivated. During scenario 814, the second obstruction device 715 is in the open configuration to allow passage of fluids between the third compressor 705 and the second compressor 704 and the first obstruction device 714 is in the closed configuration to restrict passage of fluids to the first compressor 702.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A compressor system comprising:

a first compressor, a second compressor, and a third compressor;

a common equalization line fluidly coupling the first compressor, the second compressor, and the third compressor, the common equalization line providing a single path for passage of fluids between the first compressor, the second compressor, and the third compressor;

wherein the common equalization line is fluidly coupled to the first compressor, the second compressor, and the third compressor at a point between a minimum prescribed fluid level and a nominal fluid level to thereby form a vertical position of the common equalization line sufficient to allow passage of the fluids between the first compressor, the second compressor, and the third compressor;

a valve disposed in the common equalization line between the first compressor and the second compressor;

wherein, when the first compressor is deactivated, the second compressor is activated, and the third compressor is activated, the valve is in a closed configuration thereby preventing flow of fluid between active compressors of the first compressor and the second compressor and the third compressor and de-activated compressors of the first compressor and the second compressor and the third compressor;

wherein, when the first compressor is activated, the second compressor is deactivated, and the third compressor is deactivated, the valve is in a closed configuration thereby preventing flow of fluid between active compressors of the first compressor and the second compressor and the third compressor and de-activated compressors of the first compressor and the second compressor and the third compressor; and wherein prevention of fluid flow between the first compressor and the second compressor causes at least the minimum prescribed fluid level to be maintained in the first compressor, the second compressor, and the third compressor.

2. The compressor system of claim 1, wherein the first compressor, the second compressor, and the third compressor are of approximately equal capacity.

3. The compressor system of claim 1, wherein the valve is a solenoid valve.

4. The compressor system of claim 3, wherein the solenoid valve is biased in an open configuration.

5. The compressor system of claim 1, wherein the valve is in the closed configuration prior to transitioning to partial-load operation.

6. The compressor system of claim 5, wherein the valve prevents fluid starvation in at least one of the first compressor, the second compressor, and the third compressor.

7. The compressor system of claim 1, wherein 0% to 50% of a cross-sectional area of the common equalization line contains liquid.

8. The compressor system of claim 7, wherein 50% to 100% of the cross-sectional area of the common equalization line contains gaseous refrigerant.

9. A method of maintaining minimum prescribed fluid levels in a trio compressor system, the method comprising:

utilizing the trio compressor system to operate in at least one of full-load operation in which all compressors of the trio compressor system are operational, partial-load operation in which at least one compressor of the trio compressor system is de-activated, and an idle state in which all compressors of the trio compressor system are deactivated;

responsive to the trio compressor system operating in partial-load operation, closing a valve disposed between an active compressor and the at least one de-activated compressor of the trio compressor system;

wherein the valve is fluidly coupled to the trio compressor system at a point between a minimum prescribed fluid level and a nominal fluid level;

preventing, via the valve, fluid flow from the at least one compressor that is de-activated into at least one compressor of the trio compressor system that is active; and maintaining at least the prescribed fluid level in the compressors of the trio compressor system during partial-load operation.

10. The method of claim 9, comprising:

transitioning the trio compressor system from the idle state to partial-load operation; and placing the valve in a closed configuration prior to the transitioning.

11. The method of claim 9, comprising transitioning the trio compressor system from the idle state to full-load operation; and retaining the valve in an open configuration during the transition.

12. The method of claim 9, comprising transitioning the trio compressor system from partial-load operation to full-load operation such that all compressors of the trio compressor system are operational; and placing the valve in an open configuration after the transition.

13. The method of claim 9, comprising transitioning the trio compressor system from full-load operation such that all compressors of the trio compressor system are operational to partial-load operation where at least one compressor of the trio compressor system is deactivated; and placing the valve in a closed configuration prior to the transition.

14. The method of claim 9, comprising transitioning the trio compressor system from full-load operation such that all compressors of the trio compressor system are operational to idle such that no compressors of the trio compressor system are active; and retaining the valve in an open configuration during the transition.

15. The method of claim 9 wherein the valve is a solenoid valve.

16. A compressor system comprising:

a first compressor, a second compressor, and a third compressor;

a common equalization line fluidly coupling the first compressor, the second compressor, and the third compressor, the common equalization line providing a single path for passage of fluids between the first compressor, the second compressor, and the third compressor;

wherein the common equalization line is fluidly coupled to the first compressor, the second compressor, and the third compressor at a point between a minimum prescribed fluid level and a nominal fluid level to thereby form a vertical position of the common equalization line sufficient to allow passage of the fluids between the first compressor, the second compressor, and the third compressor;

a first valve disposed in the common equalization line between the first compressor and the second compressor;

a second valve disposed in the common equalization line between the second compressor and the third compressor;

wherein, responsive to one of the first compressor and the second compressor being deactivated while the other of the first compressor and the second compressor remains active, the first valve is closed prior to deactivation of the at least one of the first compressor and the second compressor thereby preventing flow of fluid between the first compressor and the second compressor; and wherein, responsive to one of the second compressor and the third compressor being deactivated while the other of the second compressor and the third compressor remains active, the second valve is closed prior to deactivation of the at least one of the second compressor and the third compressor thereby preventing flow of fluid between the second compressor and the third compressor.

17. The compressor system of claim 16, wherein:

the first valve and the second valve facilitate runtime management of the first compressor, the second compressor, and the third compressor; and the first compressor, the second compressor, and the third compressor may be of any capacity.

18. The compressor system of claim 16, wherein 0% to 50% of a cross-sectional area of the common equalization line contains liquid.

19. The compressor system of claim 18, wherein the first valve and the second valve prevents fluid starvation in at least one of the first compressor, the second compressor, and the third compressor.

* * * * *